US006345472B1

(12) United States Patent
Taylor

(10) Patent No.: US 6,345,472 B1
(45) Date of Patent: Feb. 12, 2002

(54) APPARATUS AND METHOD FOR ANCHORING AND ERECTING CONCRETE OR SIMILAR MATERIALS

(76) Inventor: Warren Taylor, 453 E. 19th St., Costa Mesa, CA (US) 92627

( * ) Notice: Subject to any disclaimer, the term of this patent is extended or adjusted under 35 U.S.C. 154(b) by 0 days.

(21) Appl. No.: 08/871,656

(22) Filed: Jun. 9, 1997

(51) Int. Cl.[7] ..... E04H 12/34

(52) U.S. Cl. ..... 52/125.4; 52/125.3; 52/125.6; 52/127.12; 52/700; 411/400; 411/407; 294/1.1; 294/89; 403/305; 403/307

(58) Field of Search ..... 52/698–700, 705, 52/125.5, 125.4, 125.6, 127.12, 125.3; 411/400, 407; 294/89, 1.1; 29/451, 453, 235; 403/305–308, 314, 118, 66

(56) References Cited

U.S. PATENT DOCUMENTS

| | | | | | |
|---|---|---|---|---|---|
| 806,408 | A | * | 5/1905 | Farrington | 52/705 |
| 806,407 | A | * | 12/1905 | Farrington | 52/705 |
| 4,338,715 | A | | 7/1982 | Capers | |
| 4,473,984 | A | * | 10/1984 | Lopez | 52/698 X |
| 4,615,554 | A | * | 10/1986 | Schilla et al. | 52/698 X |
| 4,679,362 | A | | 7/1987 | Mess | |
| D315,495 | S | | 3/1991 | Klemic, Jr. | |
| 5,067,844 | A | | 11/1991 | Bowmer et al. | |
| 5,261,198 | A | * | 11/1993 | McMillan | 52/127.12 |
| 5,732,991 | A | * | 3/1998 | Tsui | 52/125.5 X |

OTHER PUBLICATIONS

A six (6) page brochure for Schraubanker Ischebeck Titan. Applicant and applicant's attorney are not aware of the author, or date of the brochure.

* cited by examiner

*Primary Examiner*—Yvonne M. Horton
(74) *Attorney, Agent, or Firm*—J. Mark Holland

(57) ABSTRACT

An apparatus for use in concrete construction is characterized by a body having a first portion configured to be set into concrete during the casting of that concrete, and which can be removed from the concrete after the concrete has set, and thereby may be reused in a similar manner with other concrete castings. The body of the apparatus is preferably generally cylindrical and preferably includes a serrated exterior surface. The body also preferably includes a second portion configured to facilitate removal of the apparatus from the concrete, and further includes an engagement member with which other devices may be engaged. The second portion may also be engageable with an alignment member to facilitate the accuracy of insertion and removal of the apparatus from the concrete. The serrated exterior preferably interferingly engages with at least one reinforcing element formed in the concrete, to assist in positioning of the concrete. The body may also be inflatable, and thus removable from the concrete by deflating. Inflatable and non-inflatable embodiments of the apparatus find use in "no-slump" or extrusion concrete applications. A preferred method of use of the apparatus is disclosed.

27 Claims, 6 Drawing Sheets

APPARATUS AND METHOD FOR ANCHORING AND ERECTING CONCRETE OR SIMILAR MATERIALS

BACKGROUND OF THE INVENTION

This invention relates to concrete assembly systems, and specifically to a concrete anchoring, lifting, erection, and construction apparatus and method that provide removability, reusability and ease of use. The present invention lends itself to various applications, including, for example, buildings, freeways, and other heavy construction which involve erection and assembly of large panels or columns of material such as pre-cast or cast-in-place concrete.

Heavy panels or other pieces of construction material are conventionally transported, raised and positioned for assembly with the use of anchors and lift systems such as those depicted in FIGS. 1A and 1B, and as disclosed in U.S. Pat. No. 4,615,554 to Schilla, et al. Referring to FIG. 1A , for example, such prior art systems may include a permanently cast plate 1, mounted perpendicularly to a permanently cast anchor 2, which is connected a hook mechanism 3, and secured by an anchoring bolt 4. Cranes or similar devices are attached to the hook 3, and the panel is then transported, raised and positioned as needed.

Similarly, referring to FIG. 1B, such systems may include a surface lifting plate 5, connected to a hook mechanism 6 and mounted onto a permanently cast anchor 7, secured by an anchoring bolt 8. Such systems may further incorporate a permanently cast sleeve 9, which is secured to and creates a cavity about a permanently cast anchor 7, in order to permit the subsequent injection of grout or a similar adhesive compound (for affixing the panel or column in a permanent location), as generally described below in connection with FIGS. 1C and 1D.

In order to accomplish lifting and positioning of one or more panels in these prior art systems, the user typically casts several plates and anchors into each such panel, attaches hooks (although some prior art applications include hook-anchor combinations) and bolts (either before or after casting of the panel), and further takes the time to detach the hooks (if possible) and bolts after positioning, but before final assembly. The assembly and disassembly of such systems are cumbersome and time consuming (thereby increasing the risk to nearby workers and equipment), have very tight tolerances, and require the user to leave at least the anchor and plates in or on the panels even after final assembly.

Other prior art panel connection systems involve similar limitations. Examples of such other systems include permanently cast sleeves, such as depicted in FIGS. 1C and 1D, and plate connections, such as depicted in FIG. 2.

In a permanently cast sleeve system such as depicted in FIGS. 1C and 1D, a grout sleeve 105 typically is used to create void space in the column or panel, into which a connecting mechanism such as conventional rebar 106 may be inserted. Tubes 107 can then be used to inject grout or a similar adhesive into the void space surrounding rebar 106. As shown in FIG. 1D, several grout sleeves 105 may be cast into a column or panel along with pieces of conventional rebar 106, so that void space created by the grout sleeves 105 is capable of receiving the rebar 108 protruding from and cast into a separate column or panel 109. Such sleeves may also include threaded inner surfaces to permit threaded connection with anchor and hook lift assemblies similar to those discussed above, such as disclosed in U.S. Pat. No. 5,261,198 to McMillan. Even more complex insert assembly systems for creating void space in such materials are disclosed by U.S. Pat. No. 4,679,362 to Mess and U.S. Pat. No. 4,338,715 to Capers.

In a plate connection system such as shown in FIG. 2, rebar 250 is set into the panel or column, and an exposed metal plate 260 is then connected (typically via welding) to the rebar. When adjoining panels or columns are to be connected (including when a panel is to be anchored to a foundation or footing), the metal plate 260 is then welded to corresponding metal plate 270, as illustrated by the arrow in FIG. 2.

Like the anchor and plate lift systems discussed above, other previously known connection systems (including both sleeve and plate types) require the user to leave substantial single-use accessory materials permanently cast in the panel or column after final assembly, thus increasing construction costs due to inability to reuse some or all of those components of the system. Moreover, the components which remain in the panel or column arc typically made of metal, thus increasing the possibility of rust, and consequently, decay and possible failure of the connection. In addition, the substantial cost of single-use prior art equipment often results in an insufficient number of components being used in a given application, thereby further increasing the risk of such failure.

OBJECTS AND ADVANTAGES OF THE INVENTION

It is, therefore, an object of my invention to provide an apparatus for use in the assembly of concrete material, characterized by a body having a first portion configured to be set into concrete during the casting of that concrete, and which can be removed from the concrete after the concrete has set, and thereby may be reused in a similar manner with other concrete. The body of the apparatus preferably includes a serrated exterior surface to increase the adhesion that may be achieved when joining parts together, and to enable the dispersion of lifting and load forces during transportation of the concrete, as described herein. Certain configurations of serrations can also facilitate removal of the apparatus from the concrete after casting. The serrated exterior may be preferably configured to interferingly engage with at least one reinforcing element formed in the concrete, in order to assist in lifting or other positioning of the concrete for assembly.

Another object of my invention is the provision of an apparatus of the aforementioned character, in which the aforementioned body is generally cylindrical and includes a second portion configured to facilitate rotation of the first portion of the body about its longitudinal axis to facilitate removal of the apparatus from the concrete. The apparatus may be further engageable with machinery capable of providing a continuous supply of relatively rapid setting concrete, thus providing substantial ease and economy of use over conventional prior art extrusion concrete apparatus and techniques.

A further object of my invention is the provision of an apparatus of the aforementioned character, in which the second portion of the body includes an engagement member with which other devices may be engaged to facilitate positioning of the concrete for assembly prior to removal of the apparatus from the concrete.

A still further object of my invention is the provision of an apparatus of the aforementioned character, in which the engagement member includes an aperture configured to permit access by those other devices.

Another object of my invention is the provision of an apparatus of the aforementioned character, in which the engagement member is separable from the body.

Yet another object of my invention is the provision of an apparatus of the aforementioned character, in which the first portion of the body is inflatable, and is removable from the concrete by deflating.

My invention thus provides numerous advantages over the single-use, non-removable devices of the prior art, including, by way of example and not limitation, elimination of welded plates or permanently cast sleeves which remain exposed when panels or columns are to be joined to one another, thereby also improving ease of installation and use, and consequently lowering the risk of rust or other deterioration of joints between concrete elements.

Another object of my invention is the provision of a method of use of an apparatus of the aforementioned character, including various combinations of the steps of providing concrete material, providing a form for casting the concrete material, positioning the apparatus in a selected position with respect to the form to facilitate the eventual removal and reuse of the apparatus, casting the concrete material in the form and around the apparatus, and removing the apparatus from the concrete material after casting. The removal step may further consist of rotatably removing the apparatus from the concrete material.

Yet another object of my invention is the provision of a method of the aforementioned character, including the steps of providing at least one reinforcing element, and positioning the reinforcing element in the concrete casting form between adjacent serrations on the exterior surface of the apparatus.

Still another object of my invention is the provision of a method of the aforementioned character, in which the apparatus is inflatable and the method includes the steps of inflating the apparatus prior to casting the concrete material, and deflating the apparatus to facilitate its removal from the concrete material.

A further object of my invention is the provision of a method of concrete construction, including various combinations of the steps of forming an element from concrete about a removable insert with an exposed gripping portion, gripping the gripping portion of the insert to transport the concrete element to a selected final position, removing the insert, and reusing the insert. Further steps may include positioning the concrete element so that the void created by removal of the insert is about a connecting element configured to connect the concrete element to another thing (for example and not by way of limitation, another concrete element), and pouring grout into the void and around the connecting element to provide a connection between the concrete element and the other thing.

Another object of my invention is the provision of a system for fastening discrete elements to each other, which systems includes two or more discrete elements, with one or more inserts formed in at least one of the elements. Preferably, the insert or inserts are removable from the element to form a void in the element, and at least one other of the discrete elements includes corresponding extension members insertable into the void or voids. Joining material may be injected into the void around the corresponding extension member to relatively permanent bond said discrete elements to each other. In certain applications, the elements in this system may be formed from concrete, and the extension member may be a metal rod.

Other objects and advantages of the invention will be apparent from the following specification and the accompanying drawings, which are for the purpose of illustration only.

DESCRIPTION OF PREFERRED EMBODIMENT

Figure 1A:
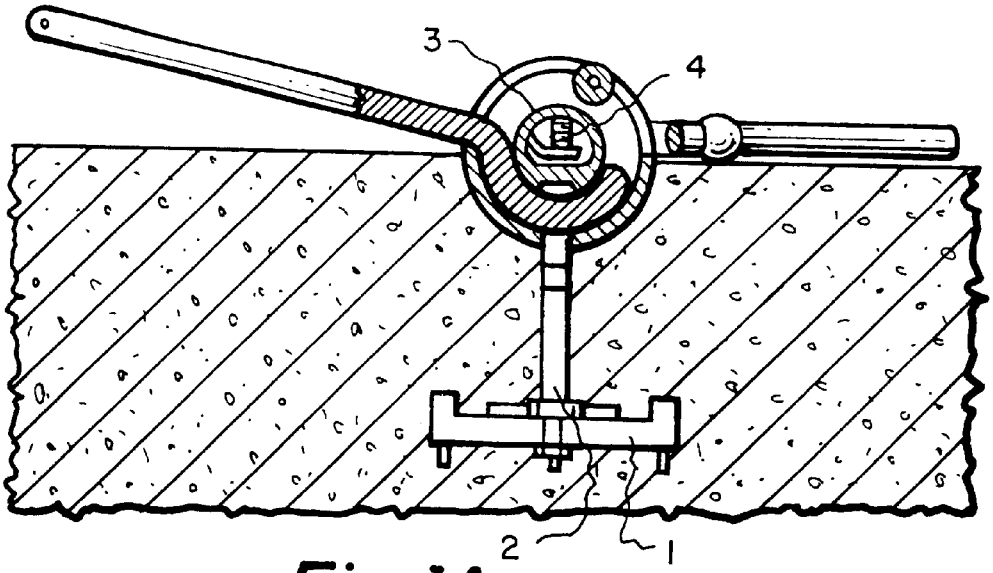
Fig. 1A. PRIOR ART
FIG. 1A is a partially sectional side view of a prior art mechanism.
Figure 1B:
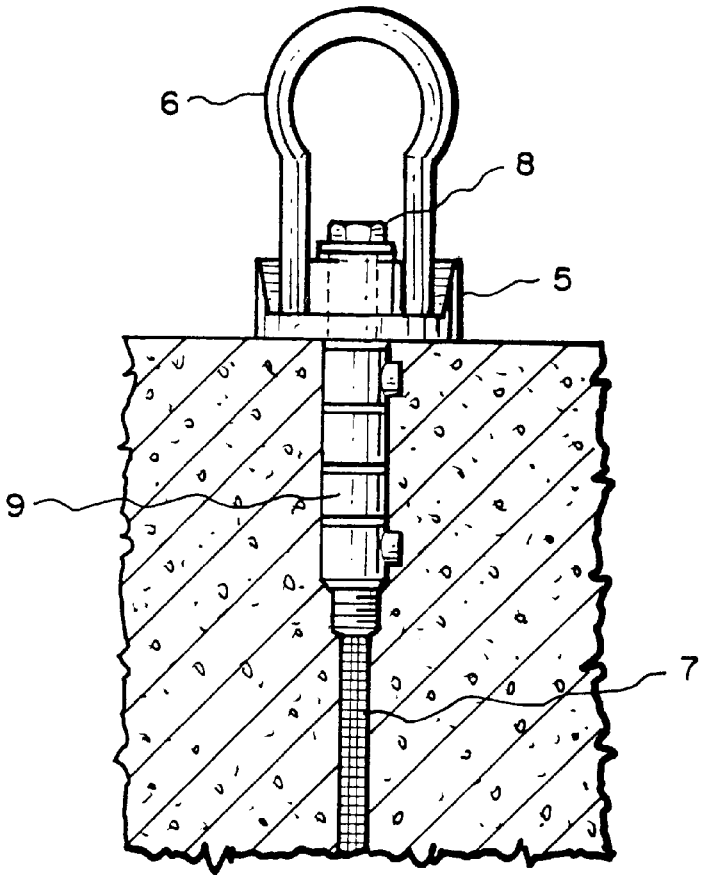
Fig. 1B. PRIOR ART
FIG. 1B is a partially sectional side view of a prior art mechanism.
Figure 1C:
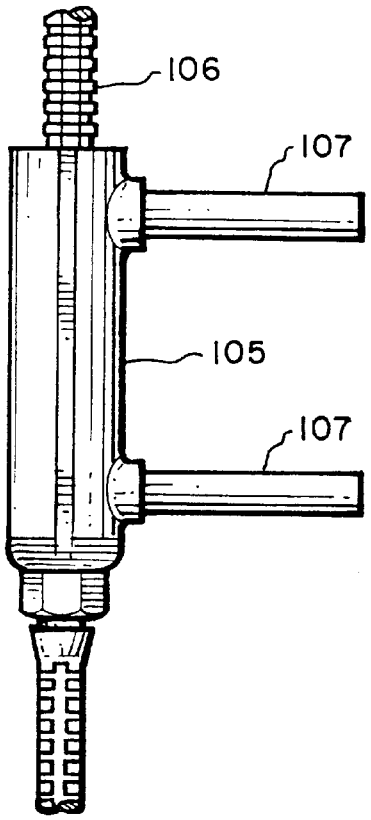
Fig. 1C. PRIOR ART
FIG. 1C is a side view of a prior art mechanism.
Figure 1D:
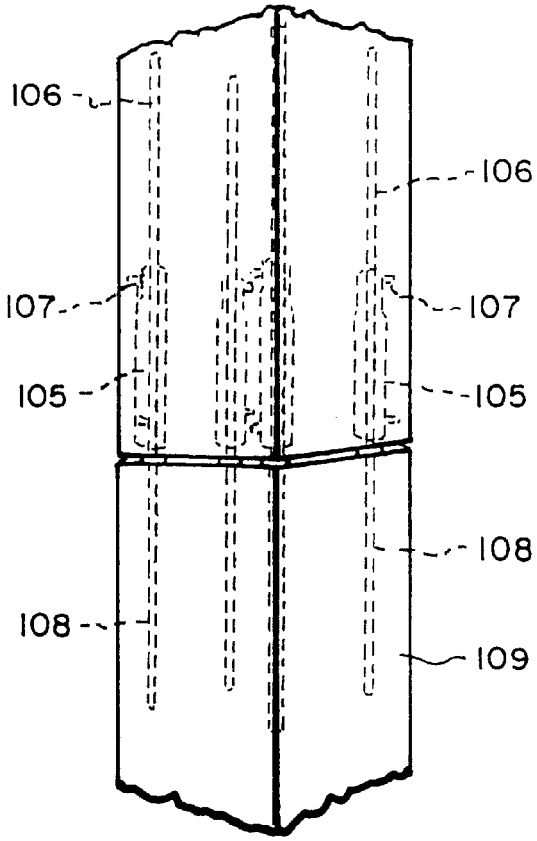
Fig. 1D. PRIOR ART
FIG. 1D is an isometric view of two concrete columns illustrating the use of the prior art concrete mechanism of FIG. 1C.
Figure 2:
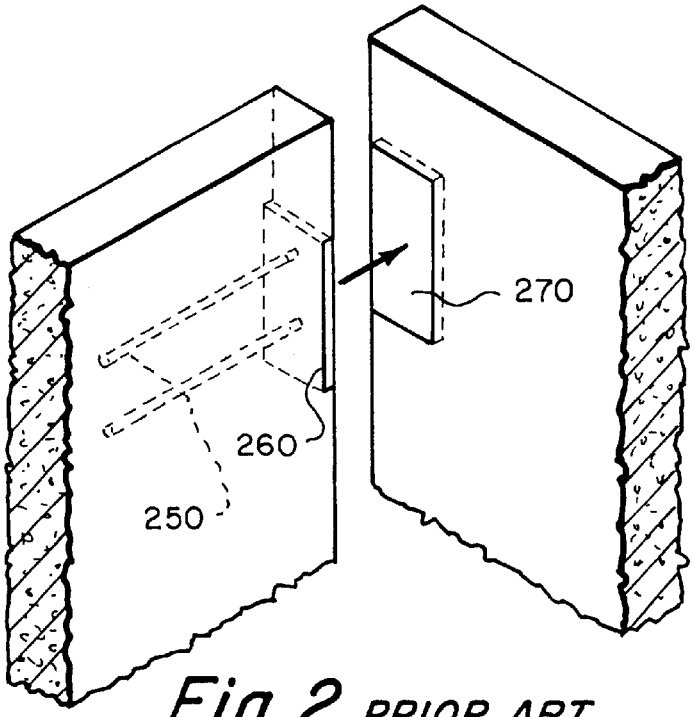
Fig. 2. PRIOR ART
FIG. 2 is an isometric view of another prior concrete anchoring system, illustrating the joining of two concrete elements.

Referring to the drawings, and particularly to FIGS. 3–9 and 12–17 thereof, I show an anchoring and construction apparatus 10 for concrete and similar materials, constructed in accordance with the teachings of the invention. The apparatus and components described herein can be made from any suitable material, including metals or other materials of similar strength, depending on the application involved, and may be manufactured by any suitable method of fabrication. By way of example and not limitation, the apparatus 10 may be forged or cast from steel. Likewise, while I discuss my invention below in terms of its preferable use in the assembly of concrete, persons of ordinary skill in the art will recognize that it may be useful in connection with transportation and assembly of discrete elements formed of other materials.

Figure 3:
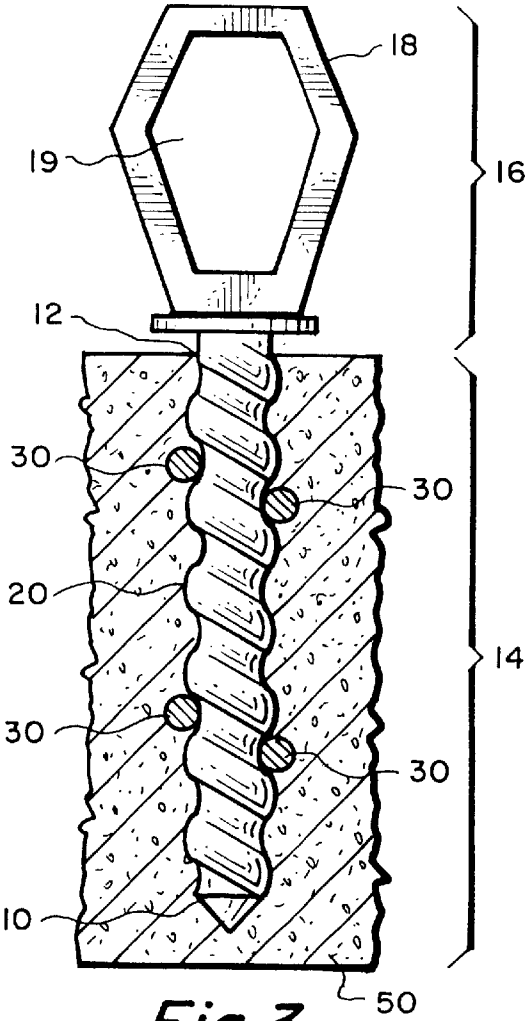
FIG. 3 is partially sectional side view of a preferred embodiment of the invention manufactured in accordance with the teachings of the invention, including a preferred embodiment of an engagement member of the invention, and reinforcing elements interferingly engaged with selected serrations of the exterior surface of the body portion of a preferred embodiment.
Figure 10:
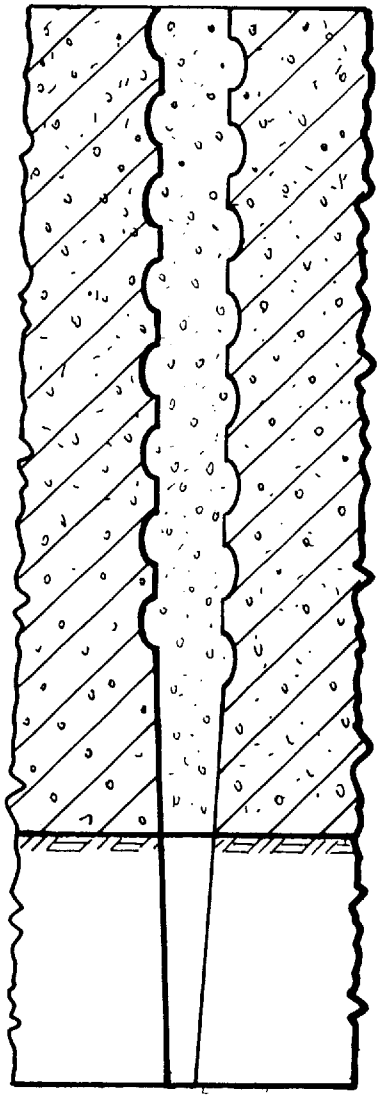
FIG. 10 is a sectional side view of a void space left in a concrete element after removal of a preferred embodiment of the insert of the invention, FIG. 11 a sectional side view of a void space left in a concrete element after removal of an inflatable apparatus similar to FIG. 12.
Figure 9:
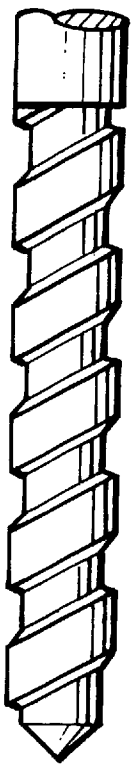
FIGS. 6–9 are side views of alternative embodiments of body portions of the invention.
Figure 8:
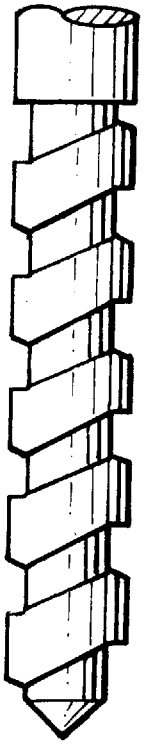
Figure 7:
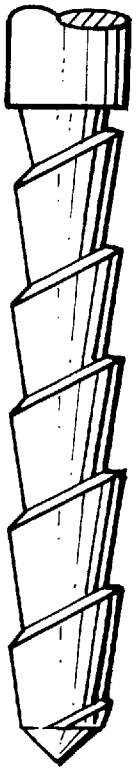
Figure 6:
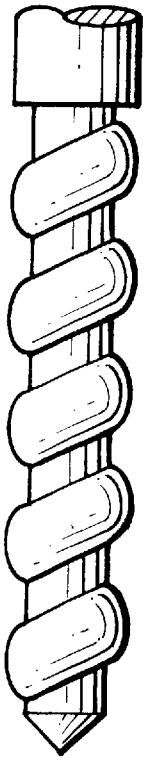

Referring specifically to FIG. 3, apparatus 10 preferably includes a body 12 with first portion 14 and a second portion 16. First portion 14 is configured to be set into concrete 50 during the casting of that concrete, and second portion 16 is configured to be exposed from the concrete 50 after the casting thereof. The first and second portions 14 and 16 of body 12 are further configured to permit non-damaging removal of the apparatus from the concrete 50 after that concrete has set, so that the apparatus may be reused in a similar manner with other concrete (not shown). As persons of ordinary skill in the art will recognize, the specific time required for the concrete to set will vary depending on a number of parameters, including, but not limited to, temperature, elevation, and composition of the concrete. Such persons of ordinary skill in the art will be able to readily adapt my invention as disclosed herein to compensate for such variations, without departing from the scope and spirit of the invention.

The first portion 14 also preferably includes a serrated exterior surface 20, which persons of ordinary skill in the art will understand may be of any suitable pattern, including by way of example and not limitation, the patterns depicted in FIGS. 6–9. Generally, these patterns include a threaded configuration, to facilitate removal of the first portion from the concrete, as described herein. Non-threaded patterns can be utilized in certain applications, however, such as the inflatable embodiments discussed below.

In preferred embodiments such as those shown in FIGS. 3–9, first portion 14 of body 12 is generally cylindrical and second portion 16 is preferably configured to facilitate rotation of first portion 14 about the longitudinal axis of first portion 14. This preferred configuration simplifies removal of the apparatus from the concrete. However, as persons of ordinary skill in the art will appreciate, numerous other shapes are possible for body 12, with or without the preferable rotational configuration, including by way of example and not limitation, conical, ovular, and spherical.

Figure 5:
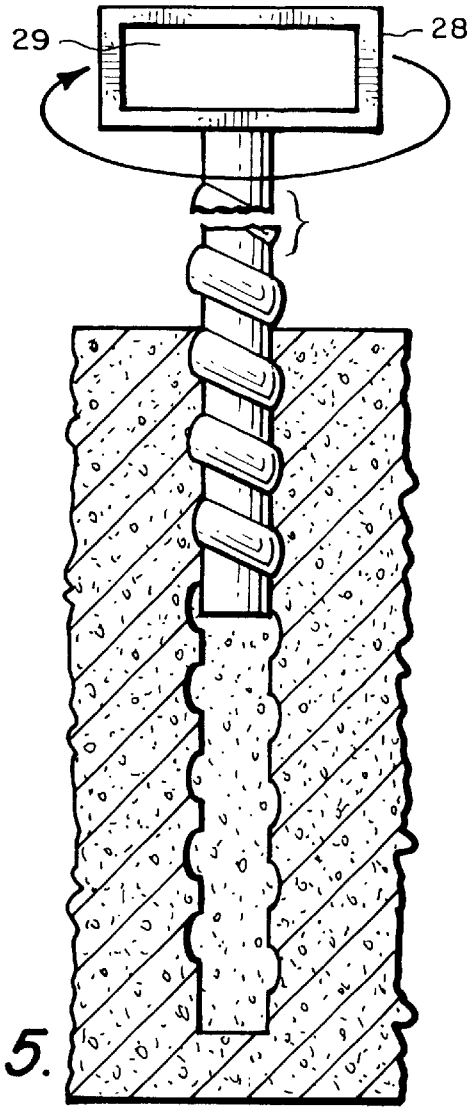
FIG. 5 is a foreshortened side view of the apparatus of FIG. 4, illustrating the preferred rotatable removal from a concrete element.
Figure 4:
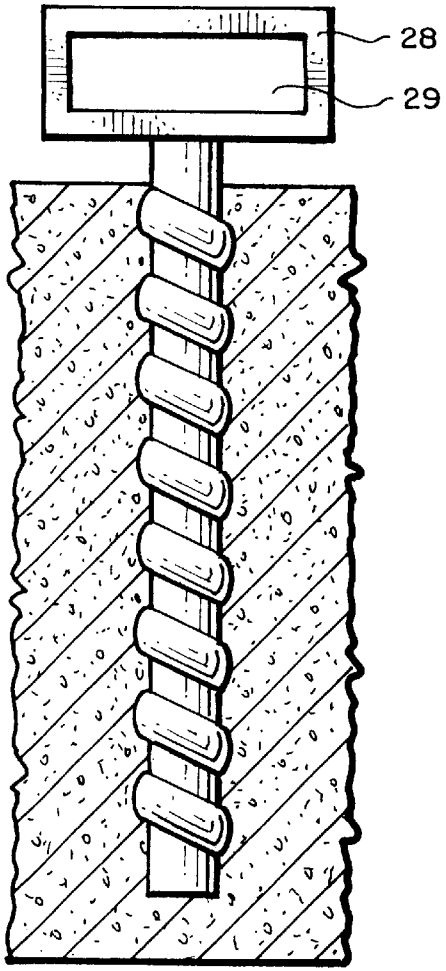
FIG. 4 is a partially sectional side view of an alternative embodiment of the invention.

The second portions 16 shown in FIGS. 3 and 4 include engagement members 18 and 29 respectively with which other devices (including, by way of example and not limitation, hooks, bars, chains, ropes, and cranes) may be engaged to facilitate transportation and positioning of the concrete 50 for assembly, either prior to removal of the apparatus from the concrete, or after removal of the apparatus from the concrete and reinstallation of the same or a similar apparatus at a later time. Such engagement members 18 and 28 also may assist in removal of the apparatus from the concrete. as shown in FIG. 5. As persons of ordinary skill in the art will appreciate, engagement members 18 and 28 may be detachable from body 12, and may be attached by any suitable attachment method, including by way of example but not limitation threading and interfering engagement.

Engagement members 18 and 28 may include apertures 19 and 29 configured to permit the aforementioned access by other devices, however, persons of ordinary skill in the art will recognize that other mechanisms (including, by way of example and not limitation, clamps, tongs, hooks, and grips) may be utilized in connection with engagement members 18 and 28 to transport and position the concrete 50. Likewise, persons of ordinary skill in the art will recognize that various shapes and alignments of such engagement members 18 may be utilized without departing from the scope of the invention. In addition, persons of ordinary skill in the art will recognize that such other mechanisms may be employed even in the absence of preferred engagement member 18, such as when the invention is constricted as shown in FIGS. 6–9. By way of example and not limitation, the rotatable removal function may be accomplished in alternative embodiments (not shown), by inclusion of a slot or channel in the upper surface of second portion 16, and rotational engagement of said slot or channel with a planar tool similar in function to a screwdriver.

In certain applications, increased precision during insertion and removal of the body portion of the invention may be necessary. Thus, referring to FIG. 15, exterior alignment member 510 may be mounted on formwork 650 (via any suitable mounting mechanism or method, including, but not limited to, nailing, gluing or pre-casting the exterior alignment member 510 onto or into formwork 650) and configured to more precisely axially align insert member 500 during insertion into a concrete element (not shown in FIG. 15). Exterior alignment member 510 may also include detachment component 512 to assist in removal of exterior alignment member 510 following its use.

Figure 15:
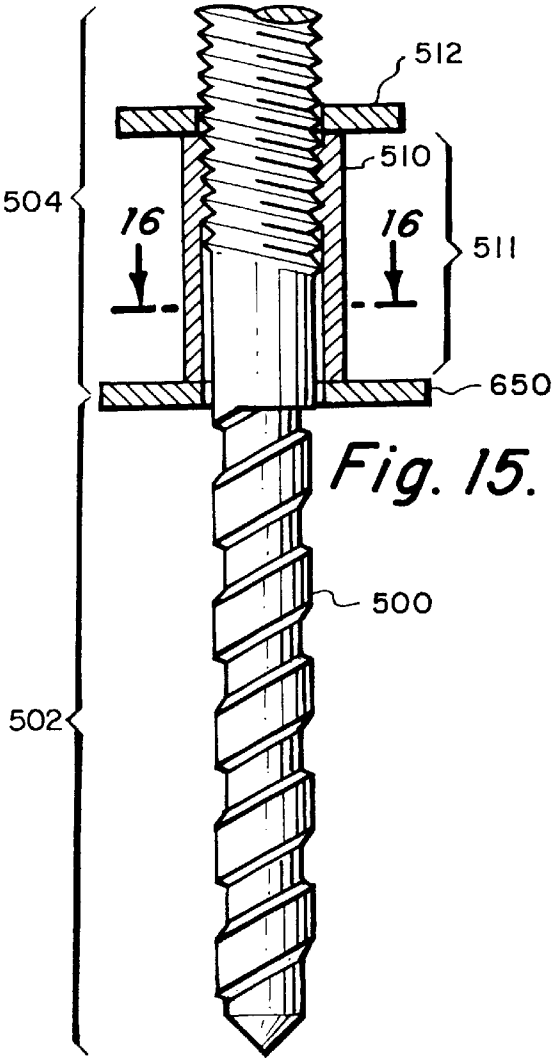
FIG. 15 is side view illustrating still other aspects of the invention.

Likewise, as shown in FIG. 15, exterior alignment member 510 can be constructed so that sleeve portion 511 is engageable with second portion 504 of insert member 500 to further assist serrated first portion 502 during removal of the apparatus from the concrete. By way of example and not limitation, threaded engagement such as that shown in FIG. 15 allows rotational removal of exterior alignment member 510 (employing detachment member 512 or otherwise) to simultaneously and precisely remove insert member 500.

Persons of ordinary skill in the art will understand that exterior alignment member 510 may be engagable with insert member 500 using any suitable engagement mechanism including, but not limited to, interference fit, threading, or bonding. As persons of ordinary skill in the art will also appreciate, exterior alignment member 510 may be constructed of any suitable material, including, but not limited to, metal, plastic, or wood, and may be of any size, shape, or configuration capable of yielding the insertion and removal attributes described above.

Focusing again on FIG. 3, the serrated exterior surface 20 provides a preferred interfering engagement with the concrete 50 that would not be present, for example, in a straight-sided, smooth-sided, void in the concrete, as discussed below. Although certain aspects of the invention can be practiced without the serrations or threads 20 (such as when sufficient gripping or adhesive frictional bonding, or other interfering engagement exists between the grout and the concrete, as in FIG. 11), as discussed below, the interfering engagement preferably increases the strength and reliability of the bond.

The serrated exterior surface 20 also may be configured to interferingly engage with at least one reinforcing element 30 formed in concrete 50. Incorporating such reinforcing elements 30 (which include by way of example and not limitation metal shear bars and stirrups, which may be fashioned from conventional rebar or any other suitable material, and may be of any suitable size and shape), assists the user in positioning of the concrete 50 by dispersing the forces associated with such positioning and with post-assembly use of the concrete, thereby lessening the possibility of cracking or failure of the concrete or other panel or column material during assembly or use. As persons of ordinary skill in the art also will understand, the number and placement of such reinforcing elements, if any, will vary according to the particular materials and application of the user.

Figure 13:
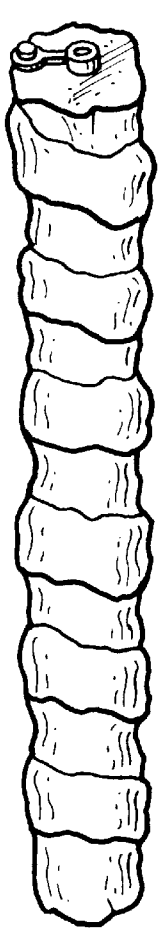
FIG. 13 is an isometric view of the inflatable apparatus of FIG. 12, after deflation.
Figure 12:
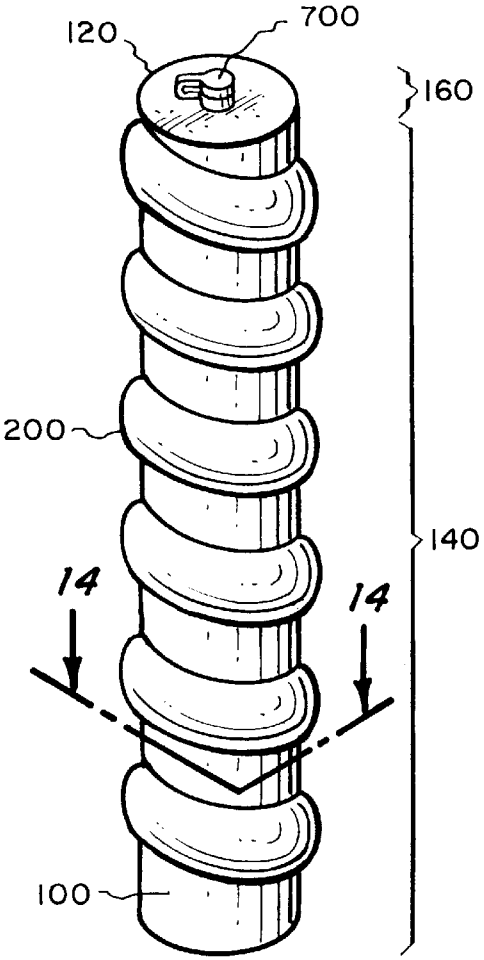
FIG. 12 is an isometric view of an inflatable embodiment the invention manufactured in accordance with the teachings of the invention.

In alternative embodiment of the invention, shown in FIGS. 12–13, the apparatus 100 includes a body 120 with a first portion 140 and a second portion 160. The first portion 140 is inflatable, and is removable from the concrete by deflating, as depicted in FIG. 13. In such an inflatable embodiment of the invention, the components, or at least first portion 140, may be preferably made of suitably tough rubber, canvas, or plastic or similar synthetic material, by injection molding, extrusion, or a similar process. Referring again to FIG. 12, a valve mechanism 700, which persons of ordinary skill in the art will appreciate can be of any suitable size or shape, is preferably included on second portion 160 to permit inflation and deflation of the invention.

The valve mechanism 700, as with the inflatable first portion 140, is preferably fabricated to withstand the wear and tear and pressure of its intended use. In concrete applications, the materials are preferably tough, as indicated above, to achieve the desired reusability. For example, the valve mechanism 700 must be capable of withstanding the pressures from the concrete slurry on the sides of the first portion 140, during pouring or casting of the concrete. If the valve failed, the concrete could collapse the first portion 140 and prevent the forming of the desired void as discussed herein. The surface of the first portion 140 preferably is non-adhering to concrete, to further facilitate its removal upon deflation and subsequent reuse.

Figure 11:
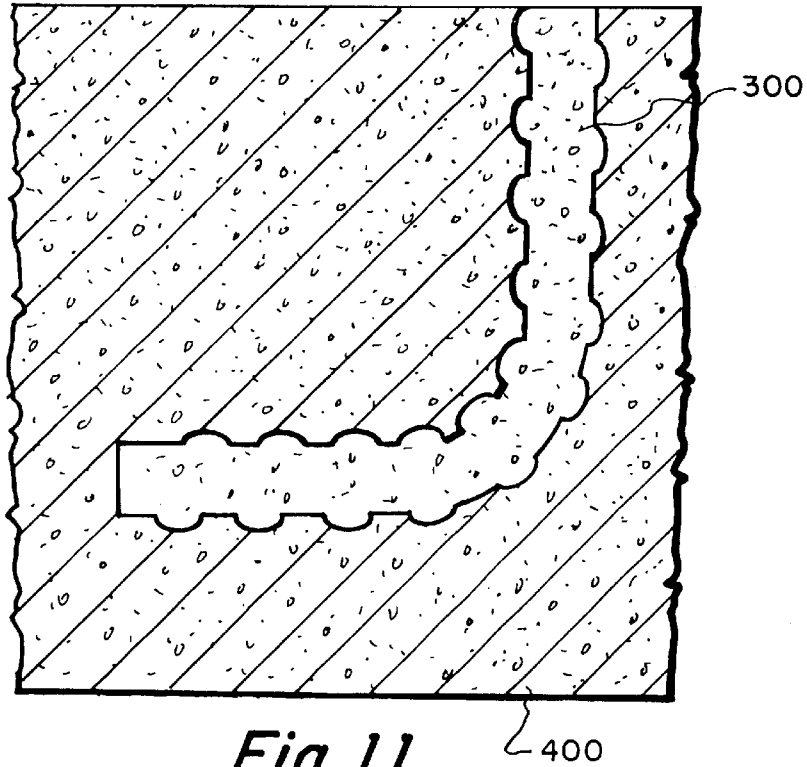
Figure 14:
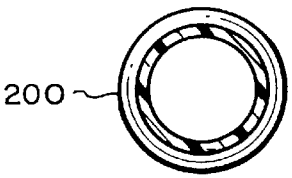
FIG. 14 is a sectional view taken along line 14—14 of FIG. 12.
Figure 16:
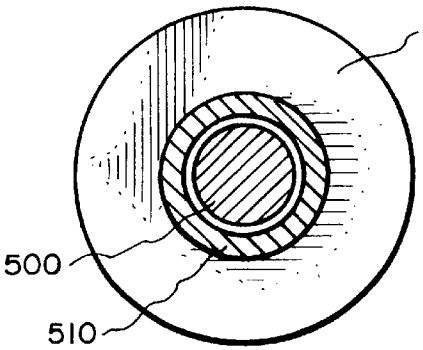
FIG. 16 is a sectional view taken along line 16—16 of FIG. 15.

Among other things, the inflatable embodiment of my invention may be formed and positioned in a wide variety of shapes, including "non-linear" shapes, to create void spaces such as depicted in FIG. 11. Persons of ordinary skill in the art will understand that such shapes can add a further aspect of strength to the assembled discrete elements, through the interfering fit of a "bent" engagement. Using FIG. 11 as an example, that void 300 could be positioned over a correspondingly shaped extension of rebar (from an adjacent concrete element, not shown) by tipping the first element 400 so that the void 300 fits "onto" the rebar. After subsequent grouting, the joint would resist direct lifting forces on the first element (other than "tipping"), because of the non-linear shape of the void, the rebar, and grout.

As noted above, serrated exterior surface 200 may be of any suitable pattern, depending on the application in question. Persons of ordinary skill in the art will also recognize that first portion 140 of an inflatable embodiment of my invention need not be cylindrical, but may take on any number of shapes, including, by way of example and not limitation, round, square, rectangular, or ovular.

Figure 17:
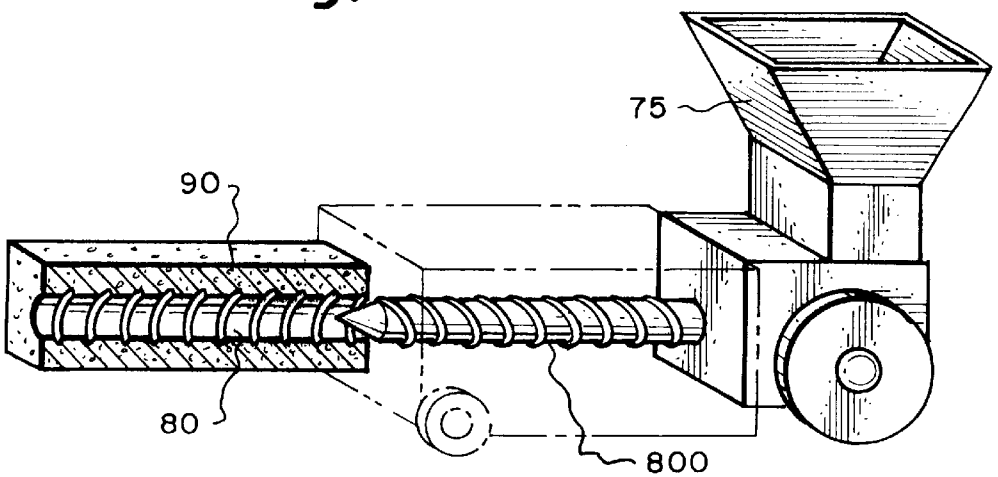
FIG. 17 is an isometric view of yet another embodiment of the invention, illustrating its usefulness in connection with concrete extrusion applications.

As illustrated by FIG. 17, the apparatus of my invention (in any of its inflatable or non-inflatable embodiments) also may be configured for use in connection with extrusion or "continuous pour" concrete systems employing "no-slump" concrete or similar rapidly-hardened materials. In particular, rotatable attachment member 800, manufactured and constructed according to the teachings of my invention, may be engaged by any suitable engagement mechanism to concrete hopper 75, and rotatably removed from concrete section 90 in order to create void space 80. Persons of ordinary skill in the art will appreciate that concrete hopper 75 may be replaced in similar applications by any suitable concrete distribution machinery.

A related preferred method of creating void space in concrete other material includes various combinations of the following steps: (a) providing concrete material, (b) providing a form for casting the concrete material, (c) providing a removable, reusable insert member, (d) positioning the insert in a selected position with respect to the form, to facilitate the eventual removal and reuse of the insert member, (e) casting the concrete material in the form and around the insert member; and (f) removing the insert member from the concrete material after casting. The method can also include the steps of providing at least one reinforcing element, and positioning that at least one reinforcing element in the form between adjacent serrations on the exterior surface of the insert member. In certain applications, as discussed above, the preferred removal step consists of rotatably removing the insert member from the concrete material. For inflatable embodiments of the apparatus, the preferred method includes the steps of inflating the insert member prior to casting the concrete material; and deflating the insert member to facilitate removal from the concrete material.

Another related preferred method of concrete construction includes various combinations of the following steps: (a) forming an element from concrete, the element having formed therein a removable insert with an exposed gripping portion, (b) gripping the gripping portion of the insert to transport the concrete element to a selected final position, and (c) removing to the insert. This method can also include the step of reusing the insert in a similar manner on other concrete elements, and the various steps of the method may be repeated on numerous adjacent concrete elements. Likewise, the original removable insert, or any similarly configured insert, may be reinserted at any time to transport the concrete elements to any other selected position In applications employing "no-slump" concrete or similar rapidly-hardened materials, the insert may be attachable to machinery capable of providing a continuous supply of relatively rapid setting concrete, and the method includes the step of attaching said insert member to the machinery.

Similarly, in certain applications, as discussed above, the method may also include the steps of positioning the concrete element so that the void created by removal of the insert is about a connecting element (including, by way of example and not limitation, rebar), configured to connect the concrete element to another construction apparatus or element (including, by way of example and not limitation, another concrete element), and pouring filling material into the void and around the connecting element to provide the connection between the concrete element and the other construction apparatus or element. In certain embodiments of the invention, the connecting element can constitute an extension member. As persons of ordinary skill in the art will appreciate, such filling material can be accomplished by any number of means (including by way of example and not limitation, casting of a conventional grout tube into the concrete element), and the filling material employed may be any suitably cementatious material (including, but not limited to, concrete, grout, acrylic bonding agents, and glue).

Thus, by my invention I provide an apparatus and method for anchoring and construction of concrete or similar material which provides numerous advantages, including substantial economy and case of use, over the prior art. For example, in concrete construction, once the concrete is in place, the preferred embodiment of the device may be removed from the concrete simply by unscrewing it. My removable invention described above also enables the user to achieve a more flush fit between concrete panels and columns (since, once my invention is removed, no welded plates or permanently cast sleeves remain exposed at the point the panels or columns are to be connected), while at the same time improving the ease of installation of the panels or columns, as described more fully above. The risk of rust or other deterioration of the joint between the concrete elements is likewise reduced.

The apparatus and method of my invention have been described with some particularity, but the specific designs, constructions and steps disclosed are not to be taken as delimiting of the invention in that various obvious modifications will make themselves apparent to those of ordinary skill in the art, all of which will not depart from the essence of the invention and all such changes and modifications are intended to be encompassed within the appended claims.

I claim:

1. A method of creating void space in concrete material, including the steps of:

(a) providing concrete material;

(b) providing a form for casting said concrete material;

(c) providing a removable, reusable insert member, said insert member is attachable to machinery capable of providing a continuous supply of relatively rapid setting concrete, and said method includes the step of attaching said insert member to said machinery;

(d) positioning said insert in a selected position with respect to said form, to facilitate said removal and reuse of said insert member;

(e) casting said concrete material in said form and around said insert member;

(f) removing said insert member from said concrete material after said casting, said removal step consists of rotably removing said insert member from said concrete material;

(g) providing at least one reinforcing element; and (h) positioning said at least one reinforcing element in said form between adjacent serrations on said exterior surface of said insert member.

2. The method of claim 1, in which said insert member includes a generally cylindrical body having a serrated exterior surface.

3. The method of claim 1, in which said insert member includes a generally cylindrical body having a serrated exterior surface.

4. The method of claim 1, in which said insert member includes a generally cylindrical body having a serrated exterior surface.

5. The method of claim 1, wherein the insert member has a first portion and a second portion and wherein the method further comprising the step of providing an engagement member with said second portion; said engagement member being separable from said second portion.

6. The method of claim 5, further including the steps of providing an exterior alignment member engageable with said second portion; said exterior alignment member including a sleeve portion for assisting with coaxial alignment of said sleeve portion and said second portion.

7. The method of claim 6, wherein said exterior alignment member and said second portion have threads and wherein the method further including the step of engaging said threads.

8. The method of claim 6, further including the steps of configuring said second portion to be engageable with machinery that is capable of providing a continuous supply of relatively rapid setting concrete.

9. The method of claim 7, wherein the first portion is inflatable and wherein the method further including the steps of inflating said first portion during casting of said concrete and deflating said first portion after said concrete is cured.

10. The method of claims 5 or claim 6 or claim 7, further including the step of connecting said engagement member with other devices to facilitate positioning of said concrete during assembly.

11. A method of concrete construction, including the steps of:

(a) forming a first element from concrete, said element having formed therein a removable insert with an exposed gripping portion;

(b) gripping said gripping portion to transport said concrete element to a selected final position;

(c) removing said insert;

(d) positioning said concrete element so that the void created by removal of said insert is about a connecting element configured to connect said concrete element to another element; and (e) pouring cementations material into said void and around said connecting element to provide said connection between said concrete element and said another element.

12. The method of claim 11, including the step of reusing said insert.

13. The method of claim 11, in which said another element is another concrete element.

14. The method of claim 13, including repeating said steps for additional concrete elements positioned adjacent said first element.

15. The method of claim 11, including the steps of:

replacing said removed insert with a similarly configured insert; and gripping said gripping portion of said similarly configured insert to transport said concrete element to another selected position.

16. The method of claim 11, wherein the insert member has a first portion and a second portion and wherein the method further comprising the step of providing an engagement member with said second portion; said engagement member being separable from said second portion.

17. The method of claim 16, further including the steps of providing an exterior alignment member engageable with said second portion; said exterior alignment member including a sleeve portion for assisting with coaxial alignment of said sleeve portion and said second portion.

18. The method of claim 17, wherein said exterior alignment member and said second portion have threads and wherein the method further including the step of engaging said threads.

19. The method of claim 17, further including the steps of configuring said second portion to be engageable with machinery that is capable of providing a continuous supply of relatively rapid setting concrete.

20. The method of claim 18, wherein the first portion is inflatable and wherein the method further including the steps of inflating said first portion during casting of said concrete and deflating said first portion after said concrete is cured.

21. The method of claims 16 or claim 17 or claim 18, further including the step of connecting said engagement member with other devices to facilitate positioning of said concrete during assembly.

22. The method of claim 11, wherein the insert member includes a generally cylindrical body having a serrated exterior surface.

23. A method of creating void space in concrete material, including the steps of:

(a) providing concrete material;

(b) providing a form for casting said concrete material;

(c) providing a removable, reusable insert member, said insert member has a first portion and a second portion;

(d) positioning said insert in a selected position with respect to said form, to facilitate said removal and reuse of said insert member;

(e) casting said concrete material in said form and around said insert member;

(f) removing said insert member from said concrete material after said casting;

(g) in which said removal step consists of rotatably removing said insert member from said concrete material, and in which said insert member includes a generally cylindrical body having a serrated exterior surface;

(h) providing an engagement member with said second portion; said engagement member being separable from said second portion; and (i) providing an exterior alignment member engageable with said second portion; said exterior alignment member including a sleeve portion for assisting with coaxial alignment of said sleeve portion and said second portion.

24. The method of claim 23, wherein said exterior alignment member and said second portion have threads and wherein the method further including the step of engaging said threads.

25. The method of claim 24, further including the steps of configuring, said second portion to be engageable with machinery that is capable of providing a continuous supply of relatively rapid setting concrete.

26. The method of claim 24, wherein the first portion is inflatable and wherein the method further including the steps of inflating said first portion during casting of said concrete and deflating said first portion after said concrete is cured.

27. The method of claim 23 or claim 24, further including the step of connecting said engagement member with other devices to facilitate positioning of said concrete during assembly.

* * * * *

UNITED STATES PATENT AND TRADEMARK OFFICE

CERTIFICATE OF CORRECTION

PATENT NO. : 6,345,472 B1
DATED : February 12, 2002
INVENTOR(S) : Warren Taylor

It is certified that error appears in the above-identified patent and that said Letters Patent is hereby corrected as shown below:

Column 2,
Line 20, “arc” should read -- are --.

Column 5,
Line 66, “constricted” should read -- constructed --.

Column 10,
Line 13, “cementations” should read -- cementatious --.

Column 12,
Line 17, add Claim 28: “The method of claim 11, wherein the insert member includes a generally cylindrical body having a serrated exterior surface.

Signed and Sealed this

Twentieth Day of May, 2003

JAMES E. ROGAN
*Director of the United States Patent and Trademark Office*